United States Patent [19]

Deacey

[11] 4,213,059

[45] Jul. 15, 1980

[54] POWER SWITCHING CIRCUIT

[75] Inventor: Peter Deacey, Beaconsfield, Canada

[73] Assignee: PDM Electrical Products Ltd., Quebec, Canada

[21] Appl. No.: 937,288

[22] Filed: Aug. 28, 1978

[30] Foreign Application Priority Data

Sep. 12, 1977 [CA] Canada ..... 286491

[51] Int. Cl.[2] ..... H01H 51/27

[52] U.S. Cl. ..... 307/41; 307/142; 361/166; 361/208

[58] Field of Search ..... 307/17, 41, 24, 31, 307/138, 142; 361/166, 168, 208; 335/79, 234; 340/176

[56] References Cited

U.S. PATENT DOCUMENTS 2,892,132 6/1959 Mallory ..... 361/208 X 3,663,827 5/1972 Ford et al. ..... 361/166 X 3,794,888 2/1974 Hisano ..... 361/208

FOREIGN PATENT DOCUMENTS 45-36929 11/1970 Japan ..... 361/108

*Primary Examiner*—L. T. Hix

*Assistant Examiner*—James L. Dwyer

*Attorney, Agent, or Firm*—Beveridge, DeGrandi, Kline & Lunsford

[57] ABSTRACT

A power switching circuit for a building which allows remote operation of individual relatively small load portions such as lighting areas, climate control apparatus etc. The entire building can also be powered up or down remotely avoiding current surges by the provision of a motor driven contact arm making contact sequentially with all remote control relays.

6 Claims, 2 Drawing Figures

POWER SWITCHING CIRCUIT

This invention relates to a remote control circuit useful for switching main power circuits in buildings.

As the power distribution network in locations such as large buildings increases in size, it becomes necessary not only to control local power circuits from a remote location, but also to control such circuits with a minimum of control power. Typically in the past such buildings have had master switches for power consuming circuits such as lighting circuits which turn off and on either the entire building, or individual floors. As the cost of power increases, it becomes desirable not only to be able to control such power consuming circuits in small regions or individual offices on a floor, but also to do so by remote control. Furthermore, should a relay or the like be utilized to locally switch the power from a remote location, the relay itself must be constantly on either when the power consuming circuit is on, or constantly on when it is off. Consequently the relay itself, when multiplied by many in the building, consumes a significant amount of power.

The present invention provides means for turning power on and off from a remote location selectively, and as well, maintains the control circuit with no current flowing during the power on and power off period. Control power is consumed only during the switching interval itself. Consequently significant amounts of power are saved.

In addition, the present invitation provides means for remotely switching all power circuits on or off with the mere touch of a single button or upon provision of an equivalent operating pulse from controller equipment. Accordingly, the system may be made to perform automatic climate control, load shedding, etc. and as well, small individual portions of a building can be individually controlled from a remote central location.

In addition, the present invention allows efficient monitoring of the status of circuits under control.

The inventive power switching circuit therefore is comprised of a latching relay having a first set of contacts for switching a main power circuit on and off and a single pole double throw (or the equivalent) set of contacts. One terminal of the coil of the relay is connected in series with the moving contacts of a remote single pole double throw switch; the normally closed one of the second set of contacts of the relay is connected in series with a first diode to the second terminal of the relay coil. The normally opened one of the second set of contacts is connected in series with a second diode to the second terminal of the relay coil, the opposite poles of the first and second diodes being connected together to the second terminal. A third and a fourth diode are connected together in series across the non-moving contacts with a remote switch, the opposite poles of the third and fourth diodes being connected together. The junction of the third and fourth diodes are connected to the moving contact of the second set of contacts of the relay. A source of relay control current is connected in series with the relay coil, the second set of contacts and the remote switch. Accordingly, connection of the moving contact of the remote switch to one of the contacts having a diode connected thereto with identical polarity as the series diode connected to the second set of contacts causes current to flow through the relay coil and the second set of contacts to switch and latch, with the result of breaking of further current flow to the coil, while at the same time switching the first set of contacts. Current is therefore observed to flow only during the switching interval.

Preferably, the relay is of magnetically latched type.

In another embodiment the power switching circuit is comprised of a base plate carrying a first annular slip ring having a gap forming a break in continuity, an isolated contact being disposed on the base plate within the gap at the same radius as the ring. A second continuous slip ring is disposed on the base plate concentric with the contact ring. A contact arm is driven by a motor, and connects the second ring to the first ring. The first ring and the second ring are connected in series with the motor across the source of current, whereby current can be fed to the motor until the contact arm reaches the gap.

A third continuous annular slip ring is disposed on the base plate concentric with the contact and second rings. A multiplicity of individual contacts in a ring are also disposed at equal radii from the center of the first and second rings. A further means contacts the third slip ring and each of the contacts in a ring in sequence as the motor rotates, whereby external circuits which may be connected individually to each of the contacts in a ring or to contacts in individual relay circuits are energized once as the motor rotates and stops upon the contact arm reaching said gap.

A more detailed description of the invention is given below, and reference is made to the following drawings, in which.

Figure 1:
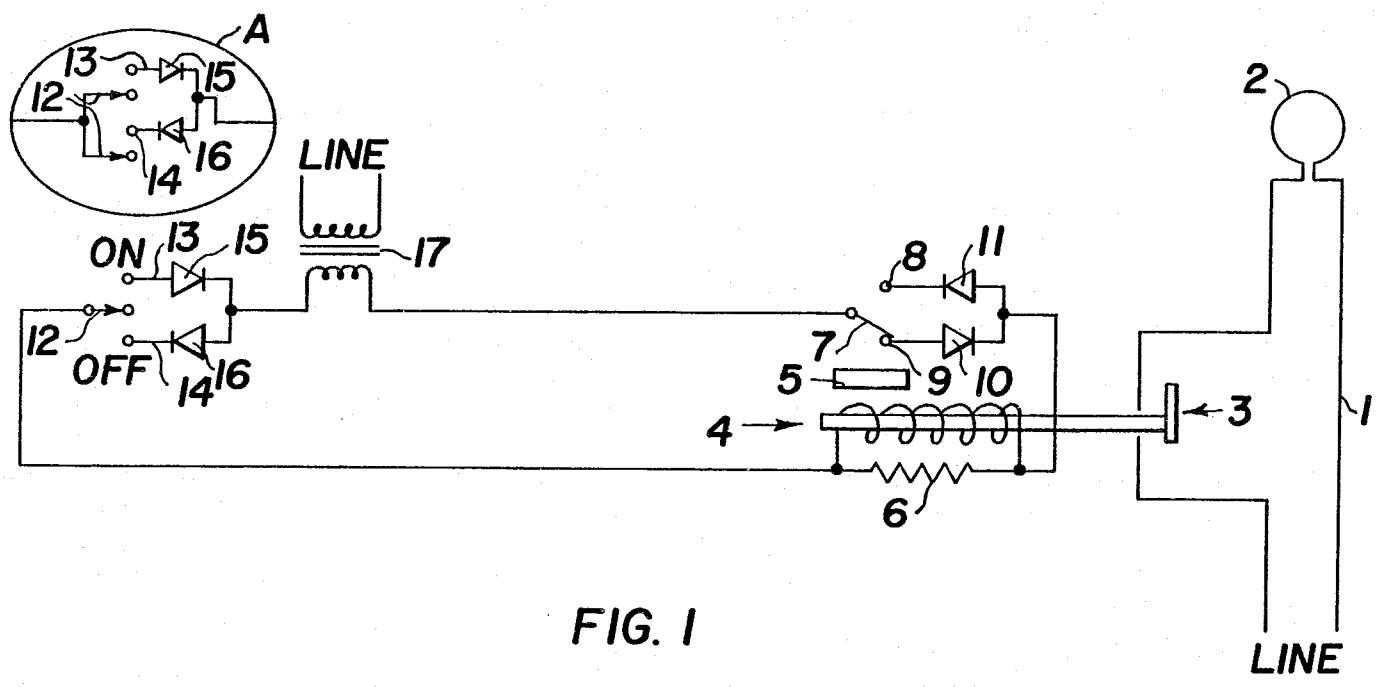
FIG. 1 is a schematic drawing of one embodiment of the invention.

Turning first to FIG. 1, a main power circuit 1 is shown which feeds a load device 2. The load device can be a local lighting circuit, heating or cooling apparatus, etc. A switch 3 is used to close the circuit to the load device.

The switch 3 is comprised of a pair of contacts of latching delay 4, which is shown as a solenoid which pulls switch 3 into closed position. Preferably the relay is of magnetic latching type, and therefore a magnet 5, part of the relay, is located in a position such as to hold the armature of the relay in one of two stable places once a pulse of current of proper polarity has passed through the relay coil. Similarly a pulse of current of opposite polarity will cause release of the armature, resulting in opening of the switch 3. A suppressor 6 may be connected across the terminals of relay 4.

A single pole double throw set of contacts is provided on the relay comprising moving contact 7, a normally open contact 8 (when switch 3 is open), and normally closed contact 9. A pair of diodes 10 and 11 are connected respectively to contacts 9 and 8, with their opposite pole terminals connected together and to one terminal of the coil of relay 4.

At a remote location a single pole triple throw switch is provided comprised of moving contact 12 and momentary on and off contacts 13 and 14 respectively. A rest or center contact is left unconnected.

In the alternative, as shown in insert A, two single pole single throw momentary contact switches are provided with one terminal of each connected together. One or the other of the switches are closed to effect operation of the circuit.

The contacts could alternattively be semiconductor switches, or relay contacts.

A pair of diodes 15 and 16 are serially connected across contacts 13 and 14, with opposite poles connected together. The junction of diodes 15 and 16 is connected through a source of a.c. current such as transformer 17 to the moving contact 7 of relay 4.

FIG. 1 shows the rest position of the circuit, with the load inoperative. To operate, the moving contact 12 is placed in contact or the equivalent with "on" contact 13. Conduction occurs during the positive excursion of the a.c. current passing from transformer 17, through diodes 15 and 10 and relay 4, which operates. This causes switch 3 to close, allowing line current to pass through load device 2.

However, upon operation of relay 4 moving contact 7 is caused to change position, breaking contact 9, and making contact 8. Since diode 11 is of opposite polarity to diode 15, current will not pass therethrough. Magnet 5 holds the relay armature and switch 3 in position, and consequently a pulse of current has been produced for operation of relay 4. Since constant holding current is not required, substantial saving in power is effected, particularly when circuits such as the present are multiplied tens, hundreds or thousands of times in a large building.

It should be noted that switching off of the pulse of power does not occur until actual operation of relay 4. The contacts of relay 4 are thus placed in a position preparatory for switching off. Further, as long as moving contact 12 is in contact with contact 13, no further operation occurs. Moving contact 12 can thus be released to its rest, non-contacting position.

To turn the main circuit off, momentary contact 12 is placed in contact with contact 14. Since diodes 11 and 16 are connected unidirectionally, in opposite sense of diodes 15 and 10, current will be conducted therethrough on the opposite half cycles of the a.c. current from transformer 17. Current will therefore pass in opposite direction to that previously in relay 4, the magnetic field of magnet 5 is counteracted, and the relay releases, opening switch 3. The moving contact 7 of the relay is caused to break with contact 8 and make with contact 9. Accordingly, only a pulse of current has passed through relay 4. The relay is now prepared to receive a pulse of current in the operate direction. Moving contact 12 of the remote switch can thus be moved to the rest or inoperative position.

Insert A in FIG. 1 shows two momentary switches to effect the same form of switching. The remote switch can be a single pole double throw switch without a centre off or rest position. Once a pulse of current has passed through the relay, leaving the remote switch in contact will cause no further current to flow, and hence it will make no further effect in the circuit. Switching the single pole double throw switch and leaving it in the switched position will similarly cause a pulsive current to flow, and nothing further. However in case of fault associated with a diode, it is preferred that the rest position of the remote switch be nonconducting.

It should also be noted that since moving contact 7 of the relay will be in contact with contact 8 when the switch 3 is closed, a lead can be taken from contact 8 to status registration circuitry. When contact is first made to contact 8, a pulse will appear on the status lead, and a lightboard or other status indicator means can be used to record which power circuits are in operation and which are not.

Figure 2:
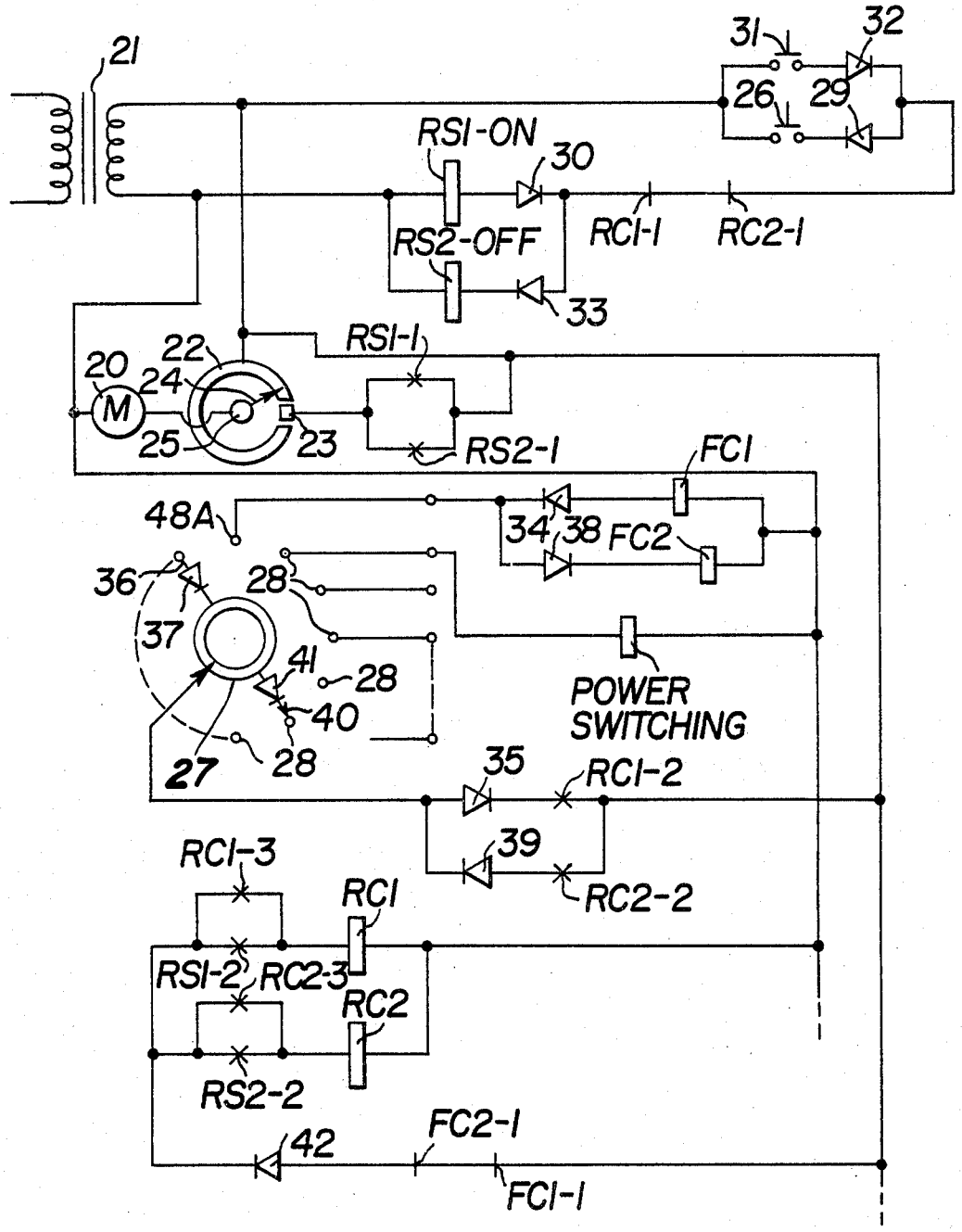
FIG. 2 is a schematic diagram of a second embodiment of the invention.

It should be noted that the effect of the remote switch can be obtained by means of remote control relays or the like. In FIG. 2, relays FC1 and FC2 provide the switch function. Contacts 12 and 13 of insert A in FIG. 1 are provided in relay FC1, and contacts 12 and 14 of the same insert are provided in relay FC2 of FIG. 2. Consequently, operation of relay FC1 will cause relay 4 to operate, and operation of relay FC2 will cause relay 4 to release. A remote control of the main circuit 1 is thus effected. However, FIG. 2 provides means for controlling a multiplicity of such circuits, and in particular, turning them all on or off.

A main feature of the circuit of FIG. 2 is a motor controlled switch. Preferably a printed circuit board is produced to have a number of conductive circular and concentric slip rings. A number of arms make contact to the slip rings, which arms are driven by motor 20. This apparatus will be described in more detail below.

A source of a.c. current such as transformer 21 is provided, the voltage of which may be typically reduced to 24 volts a.c. from 117 volts a.c. mains voltage. One of the slip rings 22 contains a gap, within which is provided an isolated contact 23. A rotating arm 24 operated by motor 20 makes contact between slip ring 25 and slip ring 22. The respective slip rings 25 and 22 are connected in series circuit with motor 20 and the secondary winding of transformer 21. When rotating arm 24 is in contact with slip ring 22, a complete circuit through the motor exists and it is caused to rotate, stopping when the circuit is broken at the aforenoted gap. In the gap, the rotating arm will be in contact with isolated contact 23.

A relay RS1 is connected in series with momentary push button 26 which, when closed, completes the circuit through relay RS1, operating it. A make contact RS1-1 is connected between isolated contact 23 and slip ring 22. When relay RS1 is operated, a current path will be provided through motor M, slip ring 25, rotating arm 24, isolated contact 23, relay RS1-1, and through the current source, transformer 21. Motor 20 therefore begins turning and once arm 24 is in contact with slip ring 22, will be caused to continue rotating. It will rotate past isolated contact 23 if relay RS1 remains operated, and will stop at isolated contact 23 is relay RS1 is released.

Also connected across the source of power is relay RC1, which is connected in series with a second make contact RS1-2 of relay RS1. In parallel with contact RS1-2 is make contact RC1-3 of the RC1 relay which operates as a holding contact for relay RC1.

When relay RS1 operates, contact RS1-2 closes, causing operation of relay RC1, and causing it to be held on through now closed contacts RC1-3 of the RC1 relay.

However, break contact RC1-1 of the RC1 relay is connected in series with the RS1 relay. As soon as the RC1 relay operates, break contacts RC1-1 open, cutting supply of current off from the RS1 relay, causing it to release.

The effect of the above is to initiate operation of relay RS1, which causes motor 20 to begin turning, and causing rotating arm 24 to begin movement. The RC1 relay operates, locking itself up, causing release of the RS1 relay. Therefore as soon as the rotating arm 24 driven by motor 20 reaches the gap in slip ring 22 and therefore touches isolated contact 23, the flow of current to motor 20 is broken, stopping rotation of the motor.

On the aforenoted circuit board is also provided an additional slip ring 27, and a ring of individual contacts 28, the contacts being at similar radii from the center of slip ring 27, the last contact being labelled 48A. A rotating arm 36 or 40 interconnects slip ring 27 with individual contacts 28 sequentially as the motor turns. Connected to each contact 28 are individual circuits comprising preferably a type 4 power switching relay connected across the current source. An FC1 relay is connected on the last contact of 28. A break contact FC-1 of the FC-1 relay is connected in series with the current supply circuit of the RC1 relay, to reset the circuit upon completion of each rotation of the motor.

Accordingly, once the motor 20 is energized, it rotates through one cycle and contact 36 makes to contact 48A. Current will be fed through the FC1 relay, contact 48A (when touched by the rotating arm), slip ring 27, and the RC1-2 contact (once the RC1 relay has made), causing operation of the FC1 relay. This causes opening of the circuit to the RC1 relay through opening of the FC1-1 break contact. Once the rotating arm has passed last contact 48A, the FC1 relay operates momentarily.

Since there will be a multiplicity of type 4 relays, each connected to a different terminal 28, all type 4 relays will be operated as the motor 20 revolves. The multiplicity of type 4 relays connected to individual contacts 28 are therefore able to control a multiplicity of individual power circuits described with reference to FIG. 1.

While the above has been a basic description of the operation of the circuit, the preferred embodiment is somewhat more complex as only the "turning on" and "aspect" of the remote control has been described. Turning off of the control can be effected as follows. Diodes 29 and 30 are connected in the same polarity sense in series with switch 26 and relay RS1 respectively. The series combination of switch 26 and diode 29 is connected in parallel with momentary contact switch 31 of similar type to switch 26, in series with diode 32 (which is connected in the opposite polarity sense to diode 29), and the series combination of relay RS1 and diode 30 is bypassed in parallel with relay RS2 which is in series with diode 33. Diode 33 is connected in serial similar polarity as diode 32.

A make contact RS2-1 of the RS2 relay is connected in parallel with contact RS1-1.

An RC2 relay in series with make contact RS2-2 of the RS2 relay which contact is in parallel with holding make contact RC2-3 of the RC2 relay is connected in parallel with the series circuit of the RC1 relay and the RS1-2 contact. A diode 34 is connected in series with the FC1 relay and a diode 35 is connected in the same polarity sense as diode 34 in series with the RC1-2 contact. Further, rotating arm 36 is provided connected in series with diode 37 in the same polarity sense as diodes 34 and 35.

An FC2 relay is connected in series with a diode 38, which series connection is in parallel with the series circuit of the FC1 relay and diode 34, with diode 38 being in opposite polarity sense to diode 34. A make contact RC2-2 of the RC2 relay is connected in series with a diode 39 which is connected in parallel with the series circuit of contact RC1-2 and diode 35, with diode 39 in opposite polarity sense to diode 35. In addition, rotating arm 40 contains diode 41 which is in the same polarity sense as diode 39. A break contact FC2-1 of the FC2 relay is connected in series with contact FC1-1 in the current path of the RC1 and RC2 relays. In addition, diode 42 is connected in the same current path to rectify AC current which would otherwise be applied to the RC relays, and thus allows DC relays similar to the RS and PC relays to be used as the RC1 and RC2 relays. The polarity sense of diode 42 is unimportant unless required by the nature of the RC relay.

In operation of the circuit, actuation of the RC1 relay or relays will be as described above. The polarity of the diodes in series with the RS1, FC1, and RC1 relays, the RC1 and FC1 contacts, and switch 26 cause current to pass only through these circuits in the correct sense as described above. Relays RS2, FC2 and RC2 will remain unaffected.

To switch all of the remote circuits off from a remote location, switch 31 is depressed, causing currents to pass therethrough in the opposite half cycle of the AC current from transformer 21 than previously described. The RS2 relay will therefore be caused to operate, and the RS1 relay will be unaffected. The RS2-1 make contact closes, causing isolated contact 23 to be energized, allowing current to pass through motor 20 and causing it to begin rotation with accompanying rotation of arm 24 as well as arms 36 and 40.

The RS2-2 contact will also close with operation of the RS2 relay, causing the RC2 relay to operate. The RC2-2 contact thus closes, allowing current to pass therethrough, through slip ring 27, diode 41, and through one of the contacts 28 (when the rotating arm 40 arrives thereat), through diode 38 and relay FC2 to the source of current.

With the RC2 relay operated, break contact RC2-1 also operates, breaking the current path through the RS2 relay, releasing it. With operation of the FC2 relay, break contact FC2-1 operates, breaking current flow through the RC2 relay, releasing it.

Since each of the contacts 28 is connected to a separate circuit containing a type 4 relay as above described, as the rotating arm 40 rotates, each contact 28 will be contacted in turn. As the rotating arm 40 connects with contact 48A, this will effect release of the FC2 relay, resulting in the RC2 relay also releasing.

Accordingly, the FC2 relay has operated and released, effectively resetting the system of FIG. 2.

It should be noted that upon closing of either switch 26 or 31, the RC1, RC2, FC1 and FC2 relays are caused to pulse closed at the appropriate time, relays RC1 and FC1 at the time of operating a circuit (upon rotating arm 36 contacting the appropriate contact 28), and relays RC2 and FC2 when the appropriate remote circuits are to be shut off. It should therefore be noted that contacts of either the FC or RC relays could be used as the appropriate contacts of the remote switch noted with respect to FIG. 1. Should the FC relays be used as preferred, each FC1 relay will have a pair of make contacts substituting for contacts 12 and 13 shown in insert A of FIG. 1, and each FC2 relay will have contacts substituting for contacts 12 and 14. In this configuration, each of the remote loads will be turned on or off sequentially as motor 20 rotates through 360° and rotating arms 36 and 40 make contact with the respective terminals 28. This is preferable to a single master switch suddenly turning on all of the circuits of a building, since a major current surge is avoided.

It should be noted that switches 31 and 26 need not be manually operated momentary switches as specifically noted above, but the equivalent pulses of current can be provided from an automatic control device to effect the same function of operating relays RS1 or RS2. A semiconductor switch could also be used in the alternative. The automatic device can be a timing device, climate control device, load monitor, security device, or the like.

It will now be appreciated that substantial control power is saved by the use of the present invention, and individual circuits can be easily controlled either automatically or manually from a remote location. The circuit of FIG. 2 can be bypassed by a manual switch to allow manual override, additionally enhancing flexibility. When the load of an entire building or a portion of a building is to be powered up, the present invention provides gradual loading of the circuits to the power line, thus avoiding major surges and the resulting temporary voltage reduction. The circuit furthermore has been found to be very economical both in structure and in the result of power usage of a building.

A person skilled in the art having read this specification and understanding the principles of the invention may now devise other circuits which utilize similar principles. All are considered within the scope of the present invention as defined in the appended claims.

The embodiments of the invention in which an exclusive property or priviledge is claimed are defined as follows:

1. A power switching circuit comprising
(a) a base plate carrying a first annular slip ring having a gap forming a break in continuity,
(b) an isolated contact on the base plate within the gap at the same radius as the ring,
(c) a second continuous slip ring concentric with the contact ring,
(d) a contact arm driven by a motor connecting the second ring to the contact ring,
(e) means connecting the first ring and the second ring in series with a motor across a source of a.c. current, whereby current can be fed to the motor until the contact arm reaches the gap,
(f) a third continuous annular slip ring concentric with the first and second rings,
(g) a multiplicity of contacts in a ring at equal radii from the centre of the first and second rings,
(h) means connecting the third slip ring and each of the contacts in sequence as the motor rotates, whereby external circuits connected individually to each of the contacts are energized once as the motor rotates, the motor stopping when the contact arm reaches said gap.

2. A power switching circuit as defined in claim 1, further including circuit means for applying a pulse of current to start the motor, connected to said isolated contact.

3. A power switching circuit as defined in claim 2 in which the circuit means is comprised of
(i) a momentary make switch in series with an RS1 relay connected across the source of current,
(ii) a make contact of the RS1 relay connected in series with the motor,
(iii) an RC1 relay connected across the source of current,
(iv) a make contact of the RC1 relay and a make contact of the RS1 relay connected in parallel with each other, in series with the RC1 relay; a break contact of the RC1 relay being connected in series with the RS1 relay,
(v) an FC1 relay connected to one of contacts in said ring, and in series with the third slip ring across the source of current and a second make contact of the RC1 relay, a break contact of the FC relay being connected in series with the FC1 relay, whereby upon closing of the momentary switch, the RS1 relay is caused to operate, allowing current to flow via first the isolated contact and then the first slip ring to the motor, and also causing operation of the RC1 relay and lockup through its make contact in parallel with the RS1 contact; closure of the RC1 relay causing its break contact to open the circuit with subsequent release of the RS1 relay and closure of part of the circuit to the FC1 relay whereupon rotation of the contact arm to said one of the contacts in said ring causes operation of the FC1 relay resulting in release of the FC1 and RC1 relays.

4. A power switching circuit as defined in claim 3 further including power switching relays connected to additional ones of the contacts in said ring for momentary operation thereof, and to the source of current in common, a break contact of said FC relay being connected in series with the RC1 relay.

5. A power switching circuit as defined in claim 3 or 4, further including a diode connected in series with the RS1 relay, and an RS2 relay having a diode in series therewith connected in parallel with the RS1 relay and series diode, both latter diodes being connected in opposite polarity sense; a further diode connected in series with the FC1 relay, an FC2 relay having a diode connected in series therewith connected in parallel with the FC1 relay and series diodes, both latter diodes being connected in opposite polarity sense; an RC2 relay connected in series with an RC2 and an RS2 make contact, in parallel with the RC1 relay and RS1 contact series combination, an FC2 relay break contact being connected in series with the FC1 relay break contact; a diode connected in series with the RC1 make contact in the FC relay circuit, in the same polarity sense as the diode in series with the RS1 relay; a further diode in series with an RC2 make contact, which are connected in parallel with the RC1 make contact and diode in the FC relay circuit, the latter two diodes being in the opposite polarity sense; a diode in series with the momentary switch, and a second momentary switch in series with a further diode, which are connected in parallel with the first manual switch and associated diode, the latter diode being connected in the opposite polarity sense, the polarities of the diodes being such that upon closure of one of the momentary contact switches, the RS1, RC1 power switching the FC1 relays are caused to operate with the rotation of the motor, and upon alternative closure of the other of the momentary contact switches, the RS2, RC2 and FC2 relays are caused to operate with further rotations of the motor.

6. A power switching circuit as defined in claim 5, further including a control make contact on each power switching relay, one terminal of each control contact being connected together, the other of each control contact being connected together at a junction through a pair of diodes, the opposite poles of each latter diode being connected together, said one terminals and said junction being connected in a series circuit with a magnetic latching relay and a source of current, the latching relay comprising a single pole double throw switch, the moving contact of the switch being connected in said series circuit, the non-moving contacts being connected together to a second junction through a pair of diodes having opposite poles connected to the second junction, the second junction being connected to the latching relay in said series circuit, and further including a pair of power switching contacts on the latching relay for connection to an external circuit.

* * * * *